US007377118B2

(12) United States Patent
Esslinger

(10) Patent No.: US 7,377,118 B2
(45) Date of Patent: May 27, 2008

(54) REFRIGERANT TRACKING/LEAK DETECTION SYSTEM AND METHOD

(75) Inventor: Steve L. Esslinger, Oak Grove, MN (US)

(73) Assignee: Zero Zone, Inc., North Prairie, WI (US)

( * ) Notice: Subject to any disclaimer, the term of this patent is extended or adjusted under 35 U.S.C. 154(b) by 218 days.

(21) Appl. No.: 11/417,082

(22) Filed: May 3, 2006

(65) Prior Publication Data

US 2006/0196224 A1 Sep. 7, 2006

Related U.S. Application Data

(63) Continuation-in-part of application No. 11/355,691, filed on Feb. 16, 2006.

(60) Provisional application No. 60/653,424, filed on Feb. 16, 2005.

(51) Int. Cl.
*F25B 45/00* (2006.01)

(52) U.S. Cl. ..... 62/149; 62/509

(58) Field of Classification Search ..... 62/149, 62/129, 509, 513
See application file for complete search history.

(56) References Cited

U.S. PATENT DOCUMENTS

| | | | | |
|---|---|---|---|---|
| 665,885 | A | 1/1901 | Veau | |
| 1,203,583 | A | 11/1916 | Clark | |
| 4,967,567 | A | 11/1990 | Proctor et al. | |
| 5,009,076 | A | 4/1991 | Winslow | |
| 5,161,385 | A | 11/1992 | Schumacher | |
| 5,351,037 | A | 9/1994 | Martell et al. | |
| 6,623,630 | B1 | 9/2003 | Staffler | |
| 6,629,420 | B2 * | 10/2003 | Renders | 62/129 |
| 6,787,713 | B2 | 9/2004 | Kuechenmeister et al. | |
| 2002/0121100 | A1 * | 9/2002 | Yabuki et al. | 62/228.1 |

* cited by examiner

*Primary Examiner*—Melvin Jones
(74) *Attorney, Agent, or Firm*—Michael Best & Friedrich LLP

(57) ABSTRACT

A refrigeration system includes a heat exchanger that is operable to cool a flow of compressed refrigerant and a first sensor coupled to the heat exchanger and operable to generate a first signal indicative of a heat exchanger liquid level. A reservoir is in fluid communication with the heat exchanger to receive the flow of cooled compressed refrigerant and a second sensor is coupled to the reservoir and is operable to generate a second signal indicative of a reservoir liquid level. A processor is operable to calculate a first weight of liquid within the heat exchanger in response to the first signal, and to calculate a second weight of liquid within the reservoir in response to the second signal.

20 Claims, 5 Drawing Sheets

REFRIGERANT TRACKING/LEAK DETECTION SYSTEM AND METHOD

RELATED APPLICATIONS

This application is a continuation-in-part of U.S. patent application Ser. No. 11/355,691, filed Feb. 16, 2006 which claims priority to U.S. Provisional Patent Application No. 60/653,424, filed on Feb. 16, 2005, titled "Refrigerant Tracking/Leak Detection System and Method", the entire content of both are incorporated herein by reference.

BACKGROUND

The invention relates to refrigeration systems generally used in large cooling applications. More particularly, the present invention relates to a system and method for monitoring the quantity of refrigerant within the refrigeration system.

One method of monitoring refrigerant includes placing a mechanical float within a receiver vessel of a refrigeration system. The mechanical float provides a visual indication of the level of refrigerant within the vessel. In this case, the level of refrigerant is only viewed during servicing operations. Alternatively, the mechanical float can include an electrical output signal fed to a tracking system. The tracking system generally includes a visual display and an alarm actuated when the level of refrigerant indicates a nearly empty receiver vessel. However, this method is difficult to employ in heat exchangers such as condensers.

Another method of monitoring refrigerant includes an infrared leak detector. The infrared leak detector includes a sensor placed on the outer surface of refrigeration system elements (e.g. receiver vessel, piping, valves, heat exchangers). By action of an air pump, the infrared detector can sample air surrounding the refrigeration system and detect refrigerant. The presence of refrigerant in the air can indicate the existence of a leak and thus trigger an alarm.

SUMMARY

In one embodiment, the invention provides a refrigeration system that includes a heat exchanger that is operable to cool a flow of compressed refrigerant and a first sensor coupled to the heat exchanger and operable to generate a first signal indicative of a heat exchanger liquid level. A reservoir is in fluid communication with the heat exchanger to receive the flow of cooled compressed refrigerant and a second sensor is coupled to the reservoir and is operable to generate a second signal indicative of a reservoir liquid level. A processor is operable to calculate a first weight of liquid within the heat exchanger in response to the first signal, and to calculate a second weight of liquid within the reservoir in response to the second signal.

In another embodiment, the invention provides a refrigeration system that includes a compressor operable to deliver a flow of compressed refrigerant and a condenser in fluid communication with the compressor to receive the flow of compressed refrigerant. The condenser is operable to cool the flow of compressed refrigerant. A reservoir is in fluid communication with the condenser to receive the cooled flow of compressed refrigerant and an evaporator is in fluid communication with the reservoir and is operable to cool a space in response to the passage of a portion of the cooled flow of compressed refrigerant. A container is coupled to and in fluid communication with the reservoir and a first sensor is at least partially disposed within the container and is operable to generate a first signal indicative of a first liquid level. A second sensor is coupled to the reservoir and is operable to generate a second signal indicative of a reservoir liquid level and a processor is operable to calculate a total weight of refrigerant in response to the first signal and the second signal. The processor is operable to compare the total weight of refrigerant to a known weight of refrigerant to determine a quantity of missing refrigerant.

In another embodiment, the invention provides a refrigeration system that includes a condenser having a first portion and a second portion. Each of the first portion and the second portion is operable to cool at least a portion of a flow of compressed refrigerant. A first sensor is coupled to the first portion and is operable to generate a first signal indicative of a first liquid level within the first portion. A second sensor is coupled to the second portion and is operable to generate a second signal indicative of a second liquid level within the second portion. A reservoir is in fluid communication with the condenser to receive the flow of compressed refrigerant and a third sensor is coupled to the reservoir and is operable to generate a third signal indicative of a third liquid level within the reservoir. A processor is operable to calculate a total weight of refrigerant in response to the first signal, the second signal, and the third signal.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
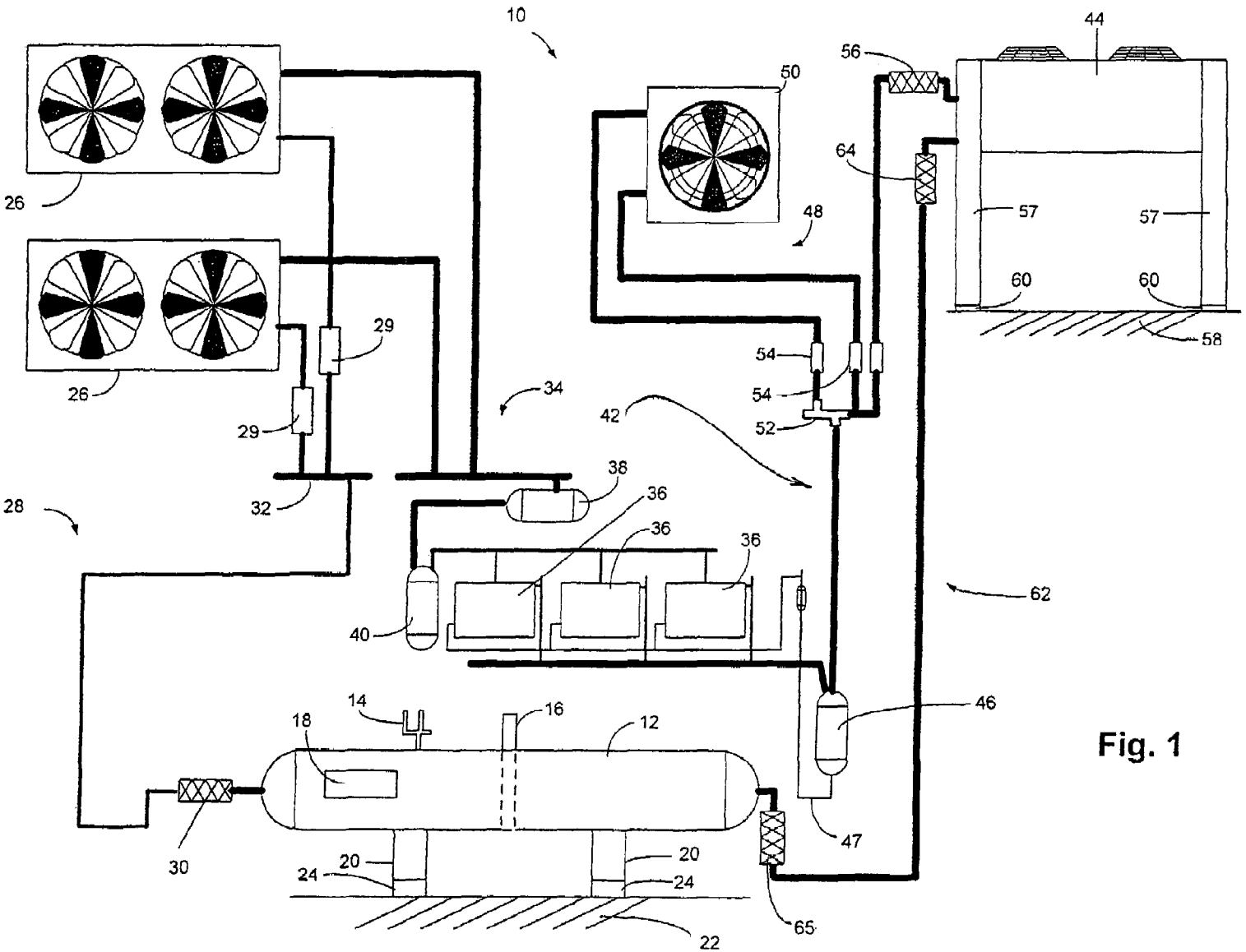
FIG. 1 is a schematic representation of a refrigeration system embodying the invention.

FIG. 1 is a schematic representation of a refrigeration system 10 operable to measure at least a portion of a mass of refrigerant within the refrigeration system 10, and to detect a quantity of refrigerant missing from the refrigeration system 10. It is to be understood that other constructions of the refrigeration system 10 are possible and that the components described herein are for illustrative purposes only. Moreover, the basic operation of refrigeration systems is known by those skilled in the art and thus will not be described in detail.

The refrigeration system 10 includes a reservoir 12 that generally contains a portion of the mass of refrigerant. More specifically, the reservoir 12 is configured to collect the portion of the mass of refrigerant and to deliver another portion of the mass of refrigerant. The portion of the mass of refrigerant collected in the reservoir 12 is generally in a liquid state. In some modes of operation of the refrigeration system 10, the amount of refrigerant within the reservoir 12 is substantially constant, as the reservoir 12 collects a flow of refrigerant and delivers another flow of refrigerant at a substantially equal rate. The reservoir 12 may be generally cylindrical and defines an enclosed space. Other constructions of the refrigeration system 10 can include a reservoir with different shapes or configurations. For example, in another construction, a plurality of tanks are interconnected to define the reservoir 12.

The reservoir 12 shown in FIG. 1 includes a relief valve 14, a liquid level probe 16, a liquid level indicator 18, and at least two supports 20. The relief valve 14 is generally used to release pressure from the reservoir 12 and can be operated automatically or manually. The liquid level probe 16 and the liquid level indicator 18 are used to measure and indicate the amount of refrigerant contained within the enclosed space of the reservoir 12. The liquid level indicator 18 can incorporate a mechanical or an electrical display to indicate a value representative of the amount of refrigerant contained in the reservoir 12.

The supports 20 include two or more legs that extend from the bottom of the reservoir 12 to support the reservoir 12 above a surface 22. A sensor 24 is generally placed between the reservoir 12 and the surface 22. For example, one sensor 24 is positioned between each support 20 and the surface 22, as shown in FIG. 1. Each sensor 24, such as a load sensor, is operable to detect at least one characteristic of the reservoir 12 and to generate a signal indicative of the at least one characteristic of the reservoir 12. In the illustrated construction, each sensor 24 is shown between one support 20 and the surface 22 such that the generated signal is at least partially indicative of the weight of the reservoir 12 and the refrigerant entrained therein. In other constructions, one sensor 24 can be placed between the reservoir 12 and the support 20. Moreover, the sensor 24 can be an integral part of the structure of each support 20. In still other constructions, more than one sensor 24 can be coupled to each support 20 or to different sections of the reservoir 12.

As shown in FIG. 1, the refrigeration system 10 also includes two heat exchangers or evaporators 26 fluidly connected to the reservoir 12 by a first piping portion 28. Each evaporator 26 is associated with one or more spaces to be cooled. As such, other constructions of the refrigeration system 10 can include more or fewer evaporators 26 as required. As shown in FIG. 1, the evaporators 26 are each associated with an expansion valve 29 that facilitates the expansion of the refrigerant. Following expansion, the low-pressure, low-temperature refrigerant flows into the heat exchanger of the corresponding evaporator 26 to provide cooling.

The first piping portion 28 and other piping portions (subsequently described) generally include metal pipes (e.g. aluminum, copper, stainless steel, galvanized steel) capable of containing the mass of refrigerant at pressure. In other constructions, the pipes can be manufactured using other materials capable of supporting the mass of refrigerant. In addition, while the term "pipe" has been used to describe the piping portions, other constructions may use tubes or other flow passages to convey fluids through the system. As such, the terms "pipe" and "piping portions" should be interpreted broadly to include any closed device, passageway, conduit, etc. suitable for conveying fluid.

The first piping portion 28 includes a first flexible pipe portion 30 in relatively close proximity to the reservoir 12, and a distribution section 32 that directs the flow of refrigerant from the reservoir 12 to the evaporators 26. In the construction shown in FIG. 1, the distribution section 32 includes a liquid manifold portion that distributes refrigerant to the two evaporators 26. In other constructions, the distribution portion 32 can define a different structure operable to feed refrigerant to a different number of evaporators 26. Moreover, the distribution portion 32, as well as other components illustrated in FIGS. 1-2, can include additional parts or sections not shown in FIGS. 1-2.

Flexible pipe portions, such as the first flexible pipe portion 30, can be manufactured using any suitable materials or configurations capable of transporting refrigerant, and preferably include resilient properties such as being capable of flexing or moving (e.g., corrugated tubes, woven tube, etc.). In the construction shown in FIG. 1, the first flexible pipe portion 30 is positioned near the reservoir 12 to help isolate the weight of the reservoir 12 and the mass of refrigerant within the reservoir 12 from the first piping portion 28. Specifically, the flexible pipe portion 30 moves in response to relative movement between the remainder of piping portion 28 and the reservoir 12. This reduces the forces applied to the reservoir 12 by the pipe portion 28 and allows for more accurate weight measurements. It is to be understood that other flexible pipe portions subsequently described also include the same characteristics and capabilities as the first flexible pipe portion 30. For example, flexible pipe portions can help isolate an element (e.g. reservoir 12) from pipes connected to the element for weighing purposes.

In the construction shown in FIG. 1, the refrigeration system 10 also includes a second piping portion 34 fluidly connecting the evaporators 26 to a compressor section that includes three compressors 36 operating in a parallel configuration. Of course, other constructions may include more or fewer compressors arranged in parallel, series or a combination as required. The second piping portion 34 includes a filter 38 and a suction accumulator 40. The compressors 36 generally receive refrigerant from the evaporators 26 and compress the refrigerant to increase the pressure of the refrigerant.

A third piping portion 42 fluidly connects the compressors 36 to a heat exchanger such as a condenser 44. In the construction shown in FIG. 1, the third piping portion 42 includes an oil separator 46 that separates oil from the refrigerant flowing from the compressors 36. A piping portion 47 routes the oil retrieved by the oil separator 46 back to the compressors 36 for re-use in the compressors 36. The third piping portion 42 also includes a sub-portion of piping 48 for delivering a portion of refrigerant through a heat reclamation coil 50. The sub-portion of piping 48 allows for the use of some of the heat produced during the compression process to heat other systems unrelated to the refrigeration system 10. The omission of the sub-portion of piping 48 does not affect the function of the invention. As such, some constructions omit the sub-portion of piping 48.

In the construction shown in FIG. 1, a valve 52 is used to direct the flow of refrigerant through the sub-portion of piping 48 or directly to the condenser 44. The sub-portion of piping 48 includes two auxiliary valves 54 to help direct the flow of refrigerant. In some modes of operation, the valve 52 directs the flow of refrigerant through the sub-portion of piping 48. In these modes of operation, the auxiliary valves 54 are generally open to allow the flow of refrigerant. In other modes of operation, the auxiliary valves 54 are closed and the valve 52 directs the flow of refrigerant directly to the condenser 44.

The condenser 44 is generally configured to receive refrigerant from the compressors 36 at a first temperature and in a gaseous state, and to release refrigerant at a second temperature, lower than the first temperature, and in a liquid state. In the construction shown in FIG. 1, the condenser 44 includes at least two supports 57 supporting the condenser 44 on a surface 58. At least one sensor 60 is placed between the condenser 44 and the surface 58. For example, a sensor 60 can be placed between the condenser 44 and the support 57 or between the support 57 and the surface 58. Similar to sensors 24, the sensors 60 are configured to detect at least one characteristic of the condenser 44 and to generate a signal indicative of the at least one characteristic of the condenser 44. In the construction shown in FIG. 1, the signal generated by each sensor 60 is at least partially indicative of the weight of the condenser 44 and the refrigerant entrained within the condenser 44. In other constructions, the sensors 60 can be placed at a location different than adjacent to the supports 57 of the condenser 44. In yet other constructions, the sensors 60 can be part of the structure to the condenser 44, thus the signal generated by the sensors 60 can be indicative of other parameters of the condenser 44 (e.g. temperature, pressure, flow rate, etc.).

The refrigeration system 10 also includes a fourth piping portion 62 to move a flow of refrigerant from the condenser 44 to the reservoir 12. The fourth piping portion 62 includes a second flexible pipe portion 64 in close proximity to the condenser 44, and a third flexible pipe portion 65 in close proximity to the reservoir 12. Additionally, the third piping portion 42 includes a fourth flexible pipe portion 56 in close proximity to the condenser 44, as shown in FIG. 1. The first and third flexible pipe portions 30, 65 cooperate with each other to help isolate the reservoir 12 from the first piping portion 28 and the fourth piping portion 62, respectively. The second and fourth flexible pipe portions 64, 56 cooperate with each other to help isolate the condenser 44 from the third piping portion 42 and the fourth piping portion 62, respectively. Isolating the reservoir 12 and the condenser 44 using the first, second, third, and fourth flexible pipe portions 30, 64, 65, 56 generally helps sensors 24, 60 generate signals that, when processed, more accurately indicate the weight of the reservoir 12, the condenser 44, and the refrigerant entrained therein.

Figure 2:
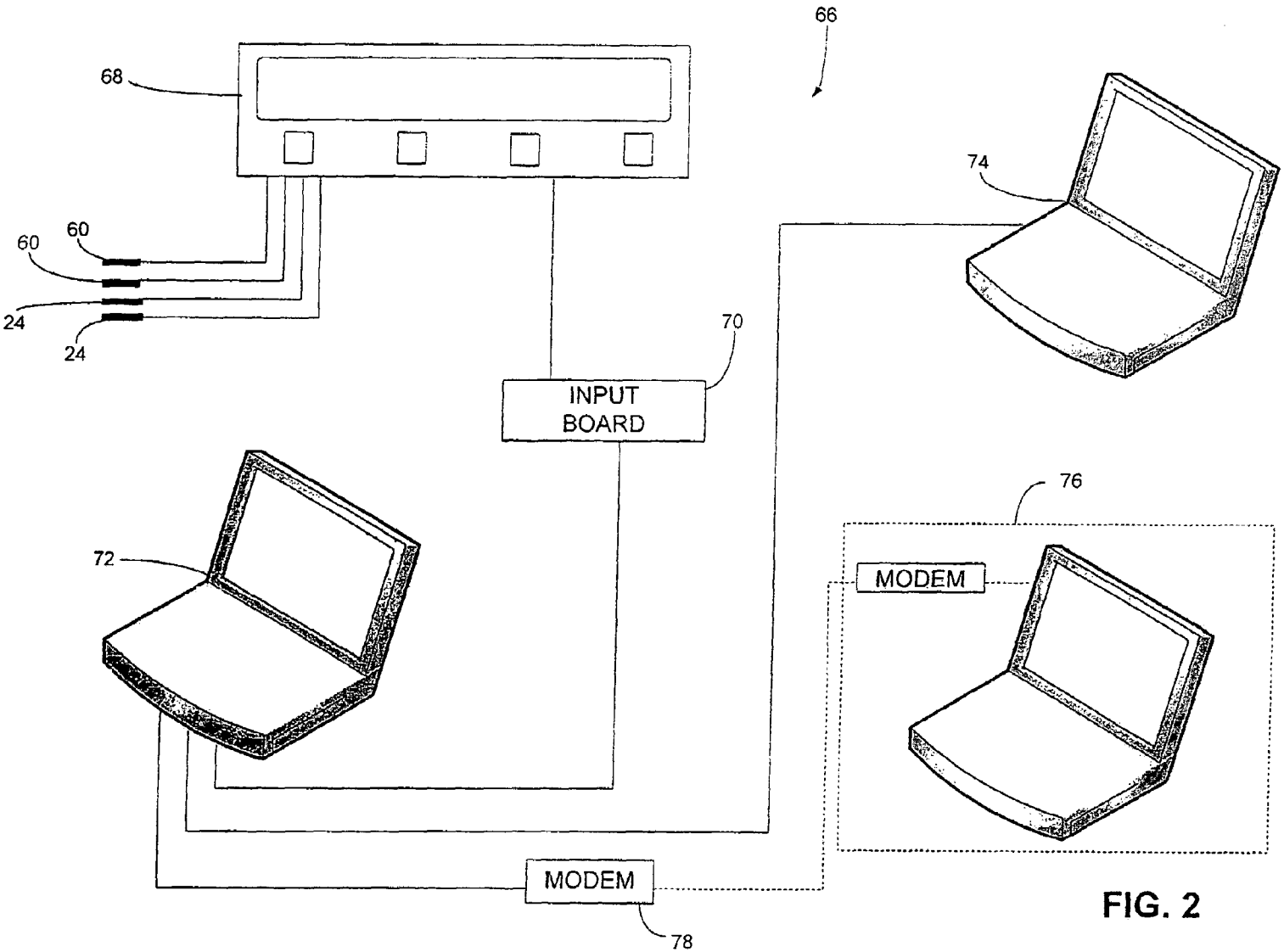
FIG. 2 is a schematic representation of a processing system, suitable for use with the system of FIG. 1 and including a number of sensors.

FIG. 2 is a schematic representation of a processing system 66 including a signal conditioner 68, an input board 70, and a rack controller 72. The sensors 24, 60 are electrically connected to the signal conditioner 68. The signal conditioner 68 receives signals generated by the sensors 24, 60, filters the signals, and generates output signals to be sent to the input board 70. Filtering the signals generally includes applying a low pass filter to the signals generated by the sensors 24, 60 to reduce noise, though other processes are possible. Some constructions can include wirelessly connecting the sensors 24, 60 to the signal conditioner 68. Other suitable means to send the signals generated by sensors 24, 60 to the signal conditioner 68 are also within the scope of the invention.

The input board 70 relays the output signals to the rack controller 72 for processing, recording, transmitting, etc. In the construction shown in FIG. 2, the processing system 66 also includes a first remote computer 74 and a second remote computer 76. For example, the first remote computer 74 can include additional processing tools to process signals from the rack controller 72 in relation to the signals generated by the sensors 24, 60. Additionally, the rack controller 72 connects to the second remote computer 76 via a modem 78 to perform operations similar to those performed by the first remote computer 74. In this case, the second remote computer 76 can be placed at a different physical location than the rest of the elements of the processing system 66. In some constructions, the processing system 66 is part of other automated systems operating the refrigeration system 10. Moreover, the processing system 66 can have other configurations than the one shown in FIG. 2.

In one mode of operation, the processing system 66 receives the signals generated by the sensors 24, 60 for processing and analysis. The signals are processed and analyzed to determine a weight of refrigerant within the reservoir 12 and a weight of refrigerant within the condenser 44. Some of the processes of the processing system 66 include filtering, amplification, recording, and comparing. More particularly, the processing system 66 can combine the calculated weight of refrigerant within the reservoir 12 and the calculated weight of refrigerant within the condenser 44 to compare it to a predetermined value. The predetermined value, generally indicating an actual weight of refrigerant within the reservoir 12 and the condenser 44, can be automatically calculated by the processing system 66 at a start up procedure or manually recorded by a user or technician. The predetermined value can also be a desired weight of refrigerant within the reservoir 12 and the condenser 44. Comparing the predetermined value to the calculated weights of refrigerant allows the processing system to determine a quantity or weight of missing refrigerant. In other modes of operation, the signals generated by the sensors 24, 60 can be processed and manipulated by the processing system 66 to determine other characteristics of the refrigeration system 10.

In general, the value indicative of the combined weight of refrigerant within the reservoir 12 and the condenser 44 is substantially constant under relatively stable operating conditions of the refrigeration system 10. The processing system 66 can continuously or periodically (e.g. once per millisecond, once per minute, every hour, etc.) monitor the weight of refrigerant within the reservoir 12 and the condenser 44. When the calculated weight of refrigerant changes to a value out of a predetermined range, the processing system 66 can initiate an alarm (e.g., audible, visual, written, etc.) indicating a possible undesired condition of the refrigeration system 10. Events that generally disrupt stable operating conditions of the refrigeration system 10, and thus produce undesired refrigerant conditions, include refrigerant leaks and sudden changes in ambient temperature. For example, in some cases the amount of refrigerant within the reservoir 12 combined with the amount of refrigerant within the condenser 44 represents a fixed percentage of the total amount of refrigerant within the refrigeration system 10. In these cases, the calculated amount of missing refrigerant exceeding a predetermined range may be indicative of a refrigerant leak.

Figure 3:
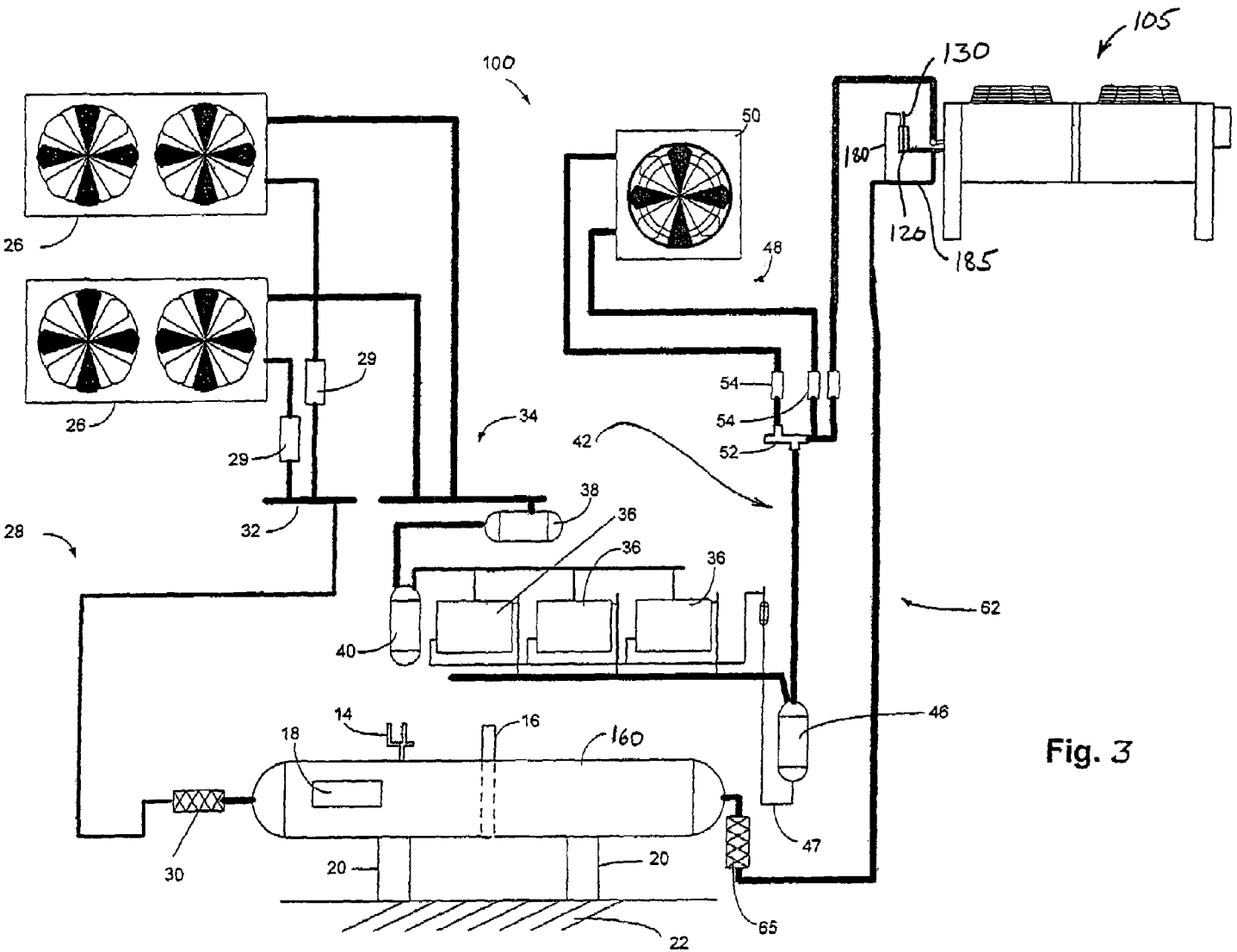
FIG. 3 is a schematic representation of another refrigeration system embodying the invention.
Figure 5:
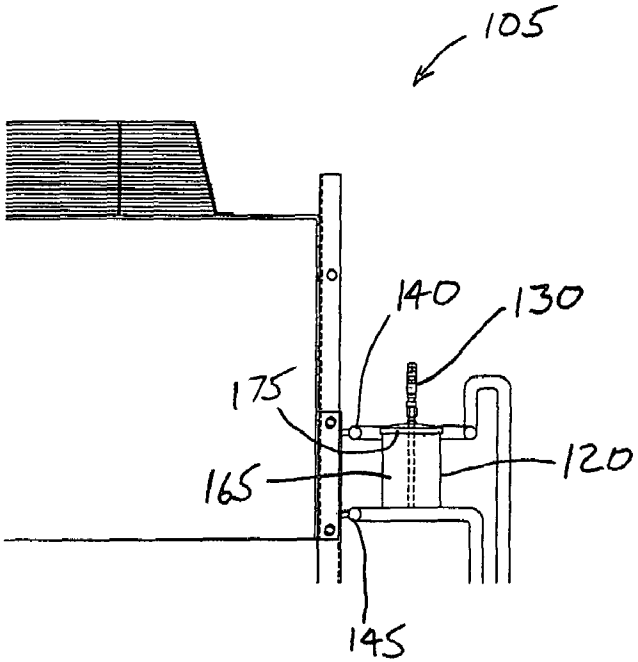
FIG. 5 is a front view of a portion of the condenser of FIG. 4.
Figure 4:
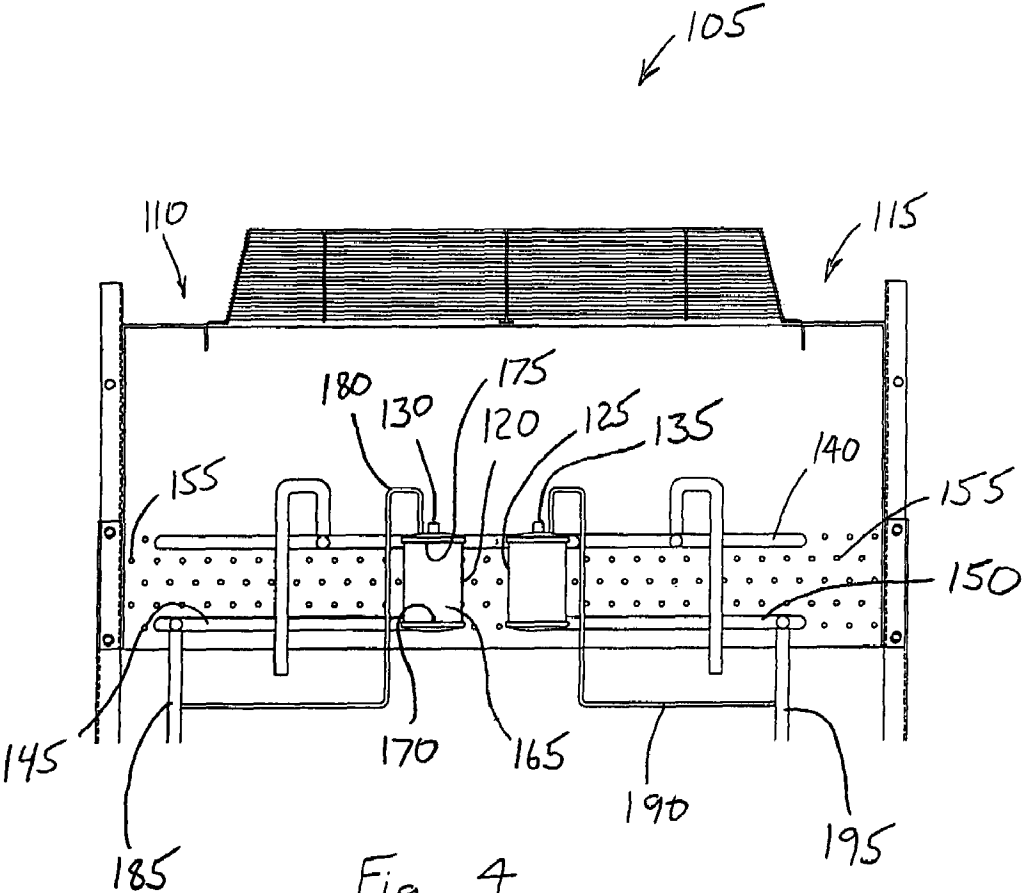
FIG. 4 is an end view of a condenser of the refrigeration system of FIG. 3.

FIGS. 3-5 illustrate another construction of a refrigeration system 100 that monitors the quantity of refrigerant within the system 100. The construction of FIGS. 3-5 has the advantage of being less expensive than the arrangement of FIG. 1 as it eliminates the need for expensive load sensors 24, 60.

FIG. 3 schematically illustrates a refrigeration system 100 that is similar to the system 10 of FIG. 1. As such, similar components will not be discussed in detail. The system 100 of FIG. 3 includes a condenser 105 that receives the flow of compressed refrigerant from the compressor 36. Rather than weighing the condenser 105 with load cells 60 or other sensors, the present construction employs a liquid level sensor.

FIG. 4 illustrates the condenser 105 as including a first portion 110, a second portion 115, a first container 120, a second container 125, a first sensor 130, a second sensor 135, an inlet header 140, a first outlet header 145, and a second outlet header 150. The first portion 110 and the second portion 115 are each able to receive a portion of the flow of compressed refrigerant and cool the flow of compressed refrigerant. In addition, the second portion 115 can be separated from the first portion 110 such that all of the flow of compressed refrigerant is cooled entirely by only one of the first portion 110 or the second portion 115. This is particularly useful during cool ambient conditions when the condenser capacity is significantly greater than what is required.

The condenser 105 includes a plurality of tubes 155 that receive the refrigerant from the inlet header 140. The inlet header 140 distributes the refrigerant to the various tubes 155 to improve the efficiency and effectiveness of the condenser 105. The refrigerant is then collected in one the first outlet header 145 or the second outlet header 150 and directed to a reservoir 160. As illustrated in FIG. 4, the first outlet header 145 and the second outlet header 150 are separate from one another such that refrigerant does not flow between the first outlet header 145 and the second outlet header 150.

The first container 120 defines a container interior 165 that has a bottom 170 and a top 175. The bottom 170 is positioned at or below the lowermost tubes 155 of the condenser 105, while the top 175 is positioned at or above the uppermost tubes 155. The lower portion of the first container 120 is in fluid communication with the first outlet header 145 such that refrigerant flows into the first container 120. An equalizer line 180 extends from the uppermost portion of the first container 120 and fluidly connects to a pipe 185 that interconnects the first outlet header 145 and the reservoir 160. The equalizer line 180 allows for the escape or entry of refrigerant from the top of the first container 120 to maintain a constant uniform pressure within the first container 120.

The arrangement of the first container 120 assures that the level of liquid refrigerant within the first portion 110 of the condenser 105 is about the same as the level of liquid within the first container 120. The equalizing line 180 assures that changes in the liquid level within the first portion 120 are reflected by equal level changes in the first container 120. Without the equalizing lines 180, pressure increases or decreases in the container 120 could affect the liquid level measured within the first container 120.

The first sensor 130 is positioned within the first container 120 and is operable to generate a signal 187 indicative of the liquid level within the first container 120. In a preferred construction, the first sensor 130 outputs an analog electrical signal (e.g., 0-5 volts, 4-20 milliamps) that is proportional to the level of liquid refrigerant within the first container 120. Of course, other constructions may employ other signals including but not limited to digital signals, optical signals, magnetic signals, and the like.

The second container 125 is similar to the first container 120 but is connected to the second portion 115. Specifically, the lowermost portion of the second container 125 is in fluid communication with the second outlet header 150 and a second equalizer line 190 extends from the uppermost portion of the second container 125 and connects to a pipe 195 between the second outlet header 150 and the reservoir 160.

The second sensor 135 is disposed within the second container 125 and is operable to generate a second signal 200 indicative of the liquid level within the second container 125. As with the first sensor 130, the second sensor 135 outputs an analog electrical signal (e.g., 0-5 volts, 4-20 milliamps, etc.) with other signals, including digital signals, optical signals, magnetic signals, and the like also being possible.

Because the second container 125 is connected to the second portion 115 of the reservoir 160 in much the same way the first container 120 is connected to the first portion 110, the liquid level measured in the second container 125 is indicative of the liquid level within the second portion 115 of the condenser 105.

The reservoir 160 includes a third liquid level sensor 16 that functions in much the same way as the first sensor 130 and the second sensor 135. Specifically, the third sensor 16 outputs an electrical signal 205 (e.g., 0-5 volts, 4-20 milliamps, etc.) that is proportional to the level of liquid refrigerant within the reservoir 160. Of course, other constructions may employ sensors that output signals other than analog electric signals (e.g., digital signals, optical signals, magnetic signals, and the like).

Figure 6:
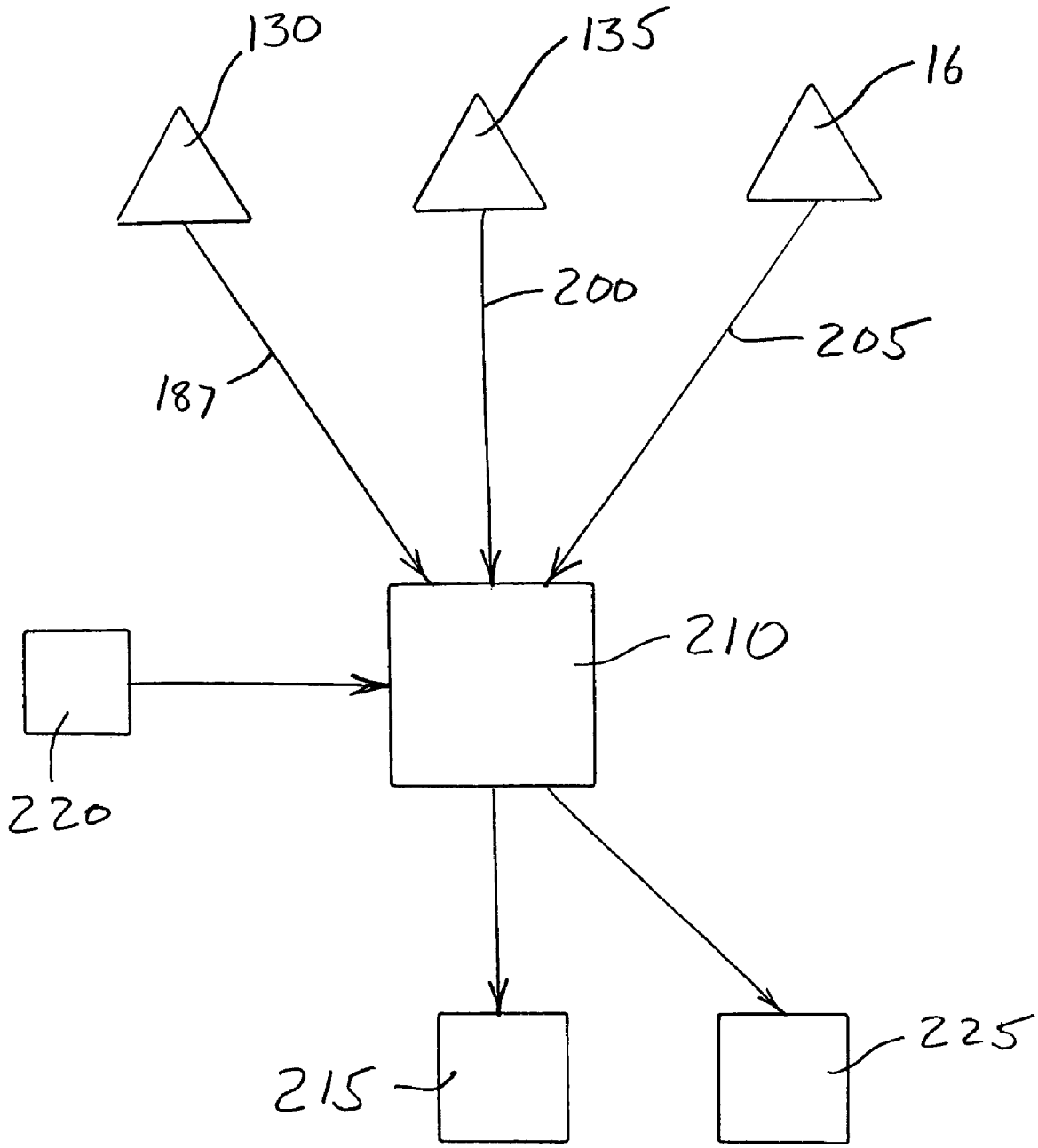
FIG. 6 is a block diagram illustrating the operation of the system of FIG. 3.

As shown in FIG. 6, a processor 210, such as is included in the rack controller 72 or one of the remote computers 74, 76, receives the first signal 187, the second signal 200, and the third signal 205 and calculates a total weight of refrigerant 215. The first signal 187 indicates the level of liquid within the first portion 110 of the condenser 105. The volume of the first portion 110, the density of the liquid refrigerant, and the density of the gas refrigerant are known and can be used to calculate the weight of refrigerant in the first portion 110. If the second portion 115 of the condenser 105 is being used, a similar calculation is carried out to calculate the weight of refrigerant within the second portion 115. If the second portion 115 of the condenser 105 is not being employed, the refrigerant is pumped from the second portion 115. However, some liquid and gas may remain and will be included in the calculation.

Similarly, the weight of refrigerant in the reservoir 160 is calculated using the liquid level (as determined by the third sensor 16), the volume of the reservoir 160, the density of the liquid refrigerant, and the density of the gas refrigerant. Once the weight of refrigerant is known, it can be added to the weight of refrigerant within the condenser 105 to arrive at the total weight 215.

Of course, refrigerant is often entrained within the piping or other components of the refrigeration system 100. However, the weight of refrigerant not in the condenser 105 or the reservoir 160 generally remains constant. As such, any leak within the system 100, no matter where it is in the system 100, generally affects the quantity (weight) of refrigerant within one of the condenser 105 or the reservoir 160 first.

While the quantity and weight of refrigerant within these other components could be calculated, the value is unnecessary as it is generally constant and can thus be ignored. In a preferred arrangement, the refrigeration system 100 is charged to a desired level and the weight of refrigerant 215 in the condenser 105 and the reservoir 160 is determined. This value is then used as a base value 220. Any reduction in the weight of refrigerant between the base value 220 and a measured value 215 would be a weight of missing or lost refrigerant 225 and could be indicative of a leak.

Various features and advantages of the invention are set forth in the following claims.

What is claimed is:

1. A refrigeration system comprising:

a heat exchanger operable to cool a flow of compressed refrigerant;

a first sensor coupled to the heat exchanger and operable to generate a first signal indicative of a heat exchanger liquid level;

a reservoir in fluid communication with the heat exchanger to receive the flow of cooled compressed refrigerant;

a second sensor coupled to the reservoir and operable to generate a second signal indicative of a reservoir liquid level; and a processor operable to calculate a first weight of liquid within the heat exchanger in response to the first signal, and to calculate a second weight of liquid within the reservoir in response to the second signal.

2. The refrigeration system of claim 1, further comprising a container coupled to and in fluid communication with the heat exchanger, the first sensor disposed at least partially within the container.

3. The refrigeration system of claim 1, wherein the heat exchanger includes a first portion and a second portion each operable to cool a portion of the flow of compressed refrigerant.

4. The refrigeration system of claim 3, wherein the second portion is separable from the first portion such that the first portion cools the entire flow of compressed refrigerant.

5. The refrigeration system of claim 3, further comprising a first container coupled to and in fluid communication with the first portion and a second container coupled to and in fluid communication with the second portion.

6. The refrigeration system of claim 5, further comprising a third sensor, and wherein the first sensor is disposed at least partially within the first container and the third sensor is disposed at least partially within the second container and is operable to generate a third signal indicative of a liquid level within the second portion.

7. The refrigeration system of claim 1, wherein the processor is operable to compare the sum of the first weight and the second weight to a known weight to determine a weight of missing refrigerant.

8. The refrigeration system of claim 1, further comprising a piping system, an evaporator, and a compressor that contain a quantity of fluid, the quantity of fluid being substantially fixed.

9. A refrigeration system comprising:

a compressor operable to deliver a flow of compressed refrigerant;

a condenser in fluid communication with the compressor to receive the flow of compressed refrigerant, the condenser operable to cool the flow of compressed refrigerant;

a reservoir in fluid communication with the condenser to receive the cooled flow of compressed refrigerant;

an evaporator in fluid communication with the reservoir and operable to cool a space in response to the passage of a portion of the cooled flow of compressed refrigerant;

a container coupled to and in fluid communication with the reservoir;

a first sensor at least partially disposed within the container and operable to generate a first signal indicative of a first liquid level;

a second sensor coupled to the reservoir and operable to generate a second signal indicative of a reservoir liquid level; and a processor operable to calculate a total weight of refrigerant in response to the first signal and the second signal, and compare the total weight of refrigerant to a known weight of refrigerant to determine a weight of missing refrigerant.

10. The refrigeration system of claim 9, wherein the condenser includes a first portion and a second portion each operable to cool a portion of the flow of compressed refrigerant.

11. The refrigeration system of claim 10, wherein the second portion is separable from the first portion such that the first portion cools the entire flow of compressed refrigerant.

12. The refrigeration system of claim 10, further comprising a second container coupled to and in fluid communication with the second portion, the container coupled to and in fluid communication with the first portion.

13. The refrigeration system of claim 12, further comprising a third sensor disposed at least partially within the second container and operable to generate a third signal indicative of a refrigerant level within the second portion.

14. The refrigeration system of claim 9, further comprising a piping system that interconnects the condenser, the compressor, the reservoir, and the evaporator, the piping system, the compressor, and the evaporator containing a substantially fixed weight of refrigerant.

15. A refrigeration system comprising:

a condenser including a first portion and a second portion, each of the first portion and the second portion operable to cool at least a portion of a flow of compressed refrigerant;

a first sensor coupled to the first portion and operable to generate a first signal indicative of a first liquid level within the first portion;

a second sensor coupled to the second portion and operable to generate a second signal indicative of a second liquid level within the second portion;

a reservoir in fluid communication with the condenser to receive the flow of compressed refrigerant;

a third sensor coupled to the reservoir and operable to generate a third signal indicative of a third liquid level within the reservoir; and a processor operable to calculate a total weight of refrigerant in response to the first signal, the second signal, and the third signal.

16. The refrigeration system of claim 15, wherein the processor is operable to compare the total weight of refrigerant to a known weight of refrigerant to determine a weight of missing refrigerant.

17. The refrigeration system of claim 15, wherein the second portion is separable from the first portion such that the first portion cools the entire flow of compressed refrigerant.

18. The refrigeration system of claim 15, further comprising a first container coupled to and in fluid communication with the first portion and a second container coupled to and in fluid communication with the second portion.

19. The refrigeration system of claim 18, wherein the first sensor is disposed at least partially within the first container and the second sensor is disposed at least partially within the second container.

20. The refrigeration system of claim 1, further comprising a piping system, an evaporator, and a compressor that contain a quantity of refrigerant that is substantially fixed.

* * * * *